US008672049B2

(12) United States Patent
Tokairin et al.

(10) Patent No.: US 8,672,049 B2
(45) Date of Patent: Mar. 18, 2014

(54) VIBRATION DRILL UNIT

(75) Inventors: Junichi Tokairin, Ibaraki (JP); Kenji Kataoka, Ibaraki (JP); Yukio Terunuma, Ibaraki (JP); Hideki Watanabe, Ibaraki (JP); Shigeru Ishikawa, Ibaraki (JP); Shinki Ohtsu, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 430 days.

(21) Appl. No.: 11/480,974

(22) Filed: Jul. 6, 2006

(65) Prior Publication Data

US 2007/0007024 A1 Jan. 11, 2007

(30) Foreign Application Priority Data

Jul. 8, 2005 (JP) ..... 2005-199845

(51) Int. Cl.
*E02D 7/02* (2006.01)

(52) U.S. Cl.
USPC ..... 173/48

(58) Field of Classification Search
USPC ..... 173/48, 49, 109, 210, 213, 217, 171; 81/463–466, 57.39; 310/76–78
See application file for complete search history.

(56) References Cited

U.S. PATENT DOCUMENTS

| | | | | | |
|---|---|---|---|---|---|
| 1,656,054 | A | * | 1/1928 | Gage | 74/25 |
| 2,160,622 | A | * | 5/1939 | Olson et al. | 173/93.6 |
| 2,223,727 | A | * | 12/1940 | Homen | 173/48 |
| 2,968,960 | A | * | 1/1961 | Fulop | 173/48 |
| 3,000,225 | A | * | 9/1961 | Taylor | 74/22 R |
| 3,223,210 | A | * | 12/1965 | Schweizer | 477/11 |
| 3,463,246 | A | * | 8/1969 | Bronnert | 173/47 |
| 3,651,907 | A | * | 3/1972 | Myer, Sr. | 192/43 |
| 3,743,067 | A | * | 7/1973 | Bokovoy | 192/43 |
| 3,809,168 | A | * | 5/1974 | Fromm | 73/13 |
| 3,841,418 | A | * | 10/1974 | Biersack | 173/109 |
| 4,538,942 | A | * | 9/1985 | Vindez | 408/14 |
| 4,621,820 | A | * | 11/1986 | Rohm | 279/19.3 |
| 4,674,347 | A | * | 6/1987 | Nishida et al. | 74/359 |
| 4,705,973 | A | * | 11/1987 | Koitabashi | 310/78 |
| 4,719,976 | A | * | 1/1988 | Bleicher et al. | 173/109 |
| 4,727,974 | A | * | 3/1988 | Takatoshi | 192/84.961 |
| 4,936,445 | A | * | 6/1990 | Grabenkort | 206/219 |
| 5,025,903 | A | * | 6/1991 | Elligson | 192/83 |

(Continued)

FOREIGN PATENT DOCUMENTS

| | | |
|---|---|---|
| CH | 2292902 | 9/1998 |
| DE | 2751506 | 5/1979 |

(Continued)

*Primary Examiner* — Robert Long
(74) *Attorney, Agent, or Firm* — McDermott Will & Emery LLP

(57) ABSTRACT

A vibration drill unit capable of obtaining an intensive drilling force. The vibration drill unit includes a first ratchet, anon-rotatable second ratchet having a claw engageable with the claw of the first ratchet, and a main body frame for accommodating a motor, a spindle, the first ratchet and the second ratchet. The respective claws of the first ratchet and the second ratchet include the first inclined surfaces formed so as to be engaged in the rotation direction by rotations of the first ratchet and so as to be separated from each other, the second inclined surfaces having greater inclination in the reversed direction than the first inclined surfaces, top parts that link the upper parts of both inclined surfaces to each other, and flat parts that link the bottom parts of both inclined surfaces to each other.

14 Claims, 4 Drawing Sheets

(56) References Cited

U.S. PATENT DOCUMENTS

| | | | | |
|---|---|---|---|---|
| 5,409,091 | A * | 4/1995 | Reik et al. | 192/70.252 |
| 5,450,914 | A * | 9/1995 | Coram | 175/73 |
| 5,505,271 | A * | 4/1996 | Bourner | 173/48 |
| 5,531,278 | A * | 7/1996 | Lin | 173/176 |
| 5,711,379 | A * | 1/1998 | Amano et al. | 173/48 |
| 5,711,380 | A * | 1/1998 | Chen | 173/48 |
| 5,871,059 | A * | 2/1999 | Shibata et al. | 173/211 |
| 6,010,426 | A * | 1/2000 | Nakamura | 477/22 |
| 6,029,787 | A * | 2/2000 | Reik et al. | 192/70.252 |
| 6,035,945 | A * | 3/2000 | Ichijyou et al. | 173/48 |
| 6,047,778 | A * | 4/2000 | Coffman et al. | 173/91 |
| 6,050,381 | A * | 4/2000 | Uehara et al. | 192/70.252 |
| 6,098,772 | A * | 8/2000 | Kimmig et al. | 192/70.252 |
| 6,142,242 | A * | 11/2000 | Okumura et al. | 173/48 |
| 6,202,759 | B1 * | 3/2001 | Chen | 173/48 |
| 6,213,222 | B1 * | 4/2001 | Banach | 173/1 |
| 6,230,819 | B1 * | 5/2001 | Chen | 173/48 |
| 6,315,060 | B1 * | 11/2001 | Schuda et al. | 173/132 |
| 6,325,192 | B1 * | 12/2001 | Reik et al. | 192/70.252 |
| 6,405,846 | B1 * | 6/2002 | Reik et al. | 192/70.252 |
| 6,688,406 | B1 * | 2/2004 | Wu et al. | 173/48 |
| 6,979,268 | B2 * | 12/2005 | Peters et al. | 464/39 |
| 7,213,659 | B2 * | 5/2007 | Saito et al. | 173/109 |
| 7,454,997 | B2 * | 11/2008 | Putney et al. | 81/57.39 |
| 7,611,005 | B2 * | 11/2009 | Uenohara | 192/70.252 |
| 7,658,238 | B2 * | 2/2010 | Toukairin et al. | 173/178 |
| 8,231,103 | B2 * | 7/2012 | Min | 251/129.11 |
| 2003/0230424 | A1 * | 12/2003 | Stirm | 173/201 |
| 2005/0133330 | A1 * | 6/2005 | Stiefvater | 192/55.1 |
| 2011/0073338 | A1 * | 3/2011 | Ikuta | 173/162.2 |

FOREIGN PATENT DOCUMENTS

| | | | |
|---|---|---|---|
| DE | 2751506 | A * | 5/1979 |
| DE | 4030027 | A * | 3/1992 |
| EP | 1504852 | A2 | 2/2005 |
| JP | 62074582 | | 4/1987 |
| JP | 63076411 | | 5/1988 |
| JP | 3041486 | | 7/1997 |
| JP | 2005-52905 | | 3/2005 |

* cited by examiner

PRIOR ART

VIBRATION DRILL UNIT

BACKGROUND OF THE INVENTION

The present invention relates to a vibration drill unit equipped with features of giving rotations and vibrations to a drill.

A conventional vibration drill unit is normally used for drilling a material to be drilled, such as, concrete, mortar, and tiles. The basic structure of a conventional vibration drill unit is described as follows.

the conventional vibration drill unit is provided with a spindle, which is driven and rotated by a motor, movably in an axial direction, and a second ratchet, which is not rotatable but movable in the axial direction, and is disposed on a first ratchet coupled to the spindle so as to be opposed to the first ratchet. The second ratchet is pressed by a spring in the axial direction to cause claws formed on the second ratchet to be engaged with claws formed on the first ratchet.

In such a conventional vibration drill unit, it is possible to select, as an operation mode, a drill mode in which only rotations are given to a drill, or a vibration drill mode in which rotations and vibrations are given to the drill at the same time. When the vibration drill mode is selected, the spindle is also movable in the axial direction. If the drill is pushed to a material to be drilled, the second ratchet moves in the axial direction to the spindle along with the main body frame, and the second ratchet is brought into contact with the first ratchet, wherein the claws of both are engaged with each other.

Therefore, by the first ratchet rotating along with the spindle in the vibration drill mode, the claw of the second ratchet gets over the claw of the first ratchet, and the second ratchet repeats being brought into contact with and separating from the first ratchet, thereby causing the spindle to vibrate in the axial direction. Since the vibration is transmitted from the spindle to a drill via the drill chuck, the drill is given vibrations and rotations at the same time. Thus, a drilling work of a material to be drilled can be efficiently carried out by the drill.

Herein, FIGS. 7(*a*) through 7(*c*) show the shapes of respective claws 34*a* and 35*a* of the first ratchet 34 and the second ratchet 35 of a conventional vibration drill unit, and states where the claws are engaged with and are disengaged from each other. Conventionally, the respective claws 34*a* and 35*a* forming ridges of the first ratchet 34 and the second ratchet 35 are composed of inclined surfaces 34*a*-1 and 35*a*-1 having a gentle inclination and inclined surfaces 34*a*-2 and 35*a*-2 having a steep inclination.

In this connection, as shown in FIG. 7(*a*), since the inclined surfaces 34*a*-1 and 35*a*-1 of the respective claws 34*a* and 35*a* of the first ratchet 34 and the second ratchet 35 are engaged with each other when the first ratchet 34 rotates in the direction of the arrow, both the ratchets 34 and 35 are spaced from each other in the axial direction, in the up and down direction of drawings as shown in FIG. 7(*b*). After that, since the second ratchet 35 is brought into contact with the first ratchet 34 by a pressing force of a spring (not illustrated), the inclined surface 35*a*-1 of the claw 35*a* of the second ratchet 35 is brought into contact with the inclined surface 34*a*-1 of the claw 34*a* of the first ratchet 34 as shown in FIG. 7(*c*). At this time, the second ratchet 35 gives an impact force F (illustrated) to the first ratchet 34.

Conventional vibration drill units as described above are disclosed, for example, in Japanese Unexamined Patent Application Publication No. 2005-052905 and Japanese Registered Utility Model Publication No. 3041486

As shown in FIGS. 7(*a*)-(*c*), in the conventional vibration drill unit, the first ratchet 34 and the second ratchet 35 are brought into collision with each other at the inclined surfaces 34*a*-1 and 35*a*-1 of the respective claws. At the time of such collision, the impact force F given from the second ratchet 35 to the first ratchet 34 in part operates on the inclined surface 35*a*-1 in the axial direction. However, the force F is truly applied to the first ratchet 34 in a direction which is inclined by an angle θ to the axial direction. Therefore, the component of the force F in the axial direction $Fx=F\cos\theta$ is smaller than the impact force F ($Fx<F$). Thus, it cannot be said that the entire kinetic energy which the second ratchet 35 imparts to the first ratchet 34 is utilized for vibrations in the axial direction. Therefore, there is a problem in that the energy loss in conventional vibration drill units is great.

Also, as illustrated in FIG. 7(*c*), $Fy=F\sin\theta$ shows the component of the impact force F in the direction orthogonal to the axial direction. In addition, in FIG. 7(*a*), reference numerals 34*a*-3 and 35*a*-3 denote the top parts of the respective claws 34*a* and 35*a*, respectively.

Also, since the respective claws 34*a* and 35*a* of the first ratchet 34 and the second ratchet 35 are not brought into collision with each other at the bottom (valley) parts thereof, but are brought into collision with each other at the inclined surfaces 34*a*-1 and 35*a*-2, the stroke S of the second ratchet 35 in the axial direction is small, and the relative speed of the second ratchet 35 is small when it was brought into collision with the first ratchet 34.

Due to the above reasons, the drilling performance of conventional vibration drill units is insufficient.

SUMMARY OF THE INVENTION

The present invention was developed in view of the above problems, and it is therefore an object of the invention to provide a vibration drill unit capable of obtaining large drilling performance.

In order to achieve the above-described object, a vibration drill unit according to a first aspect of the present invention includes a motor that is a drive source, a spindle driven and rotated by the motor and movable in an axial direction a first ratchet coupled to the spindle, a non-rotatable second ratchet having convex and concave claws engageable with convex and concave claws of the first ratchet, and a main body frame for accommodating the motor, spindle, and the first and the second ratchets. The respective claws of the first ratchet and the second ratchet have a first inclined surface formed so as to be separated from each other by being engaged in the rotation direction based on rotations of the first ratchet, a second inclined surface having a greater slope in the reverse direction of the first inclined surface than that of the first inclined surface, a ridge portion that links the respective top parts of both the inclined surfaces with each other, and a flat part that links the respective bottom parts of both the inclined surfaces with each other.

The vibration drill unit according to a second aspect of the present invention is featured, in addition to the first aspect thereof, in that the first ratchet and the second ratchet are capable of rotating relative to each other in a state where the top part of one claw of the first and second ratchets is engaged with the flat part of the other claw thereof.

The vibration drill unit according to a third aspect of the present invention is featured, in addition to the first aspect or the second aspect, in that a spring capable of causing the second-ratchet to slide in the axial direction, and upon pressing the second ratchet to the first ratchet side is compressed and mounted between the second ratchet and the main body frame.

According to the present invention, the second ratchet separated from the first ratchet by actions of the first inclined surfaces of the respective claws of the first ratchet and the second ratchet is again moved toward the first ratchet, and the flat parts of the claws are brought into collision with the top part of the claw of the first ratchet. Therefore, an impact force is exerted to the first ratchet in the axial direction. For this reason, the entire kinetic energy of the second ratchet is effectively utilized for vibrations in the axial direction, wherein the energy loss can be suppressed to the minimum. In addition, since the respective claws of the first ratchet and the second ratchet are brought into collision with each other at the top part and the flat part (bottom part), the axial direction stroke of the second ratchet is further increased than the prior art stroke, and the relative speed between the second ratchet and the first ratchet is increased when they are bought into collision with each other, that is, the kinetic energy thereof is increased. As a result, the drilling performance of the vibration drill unit is enhanced.

DETAILED DESCRIPTION OF THE INVENTION

Hereinafter, a description is given of embodiments of the invention with reference to the accompanying drawings.

Figure 1:
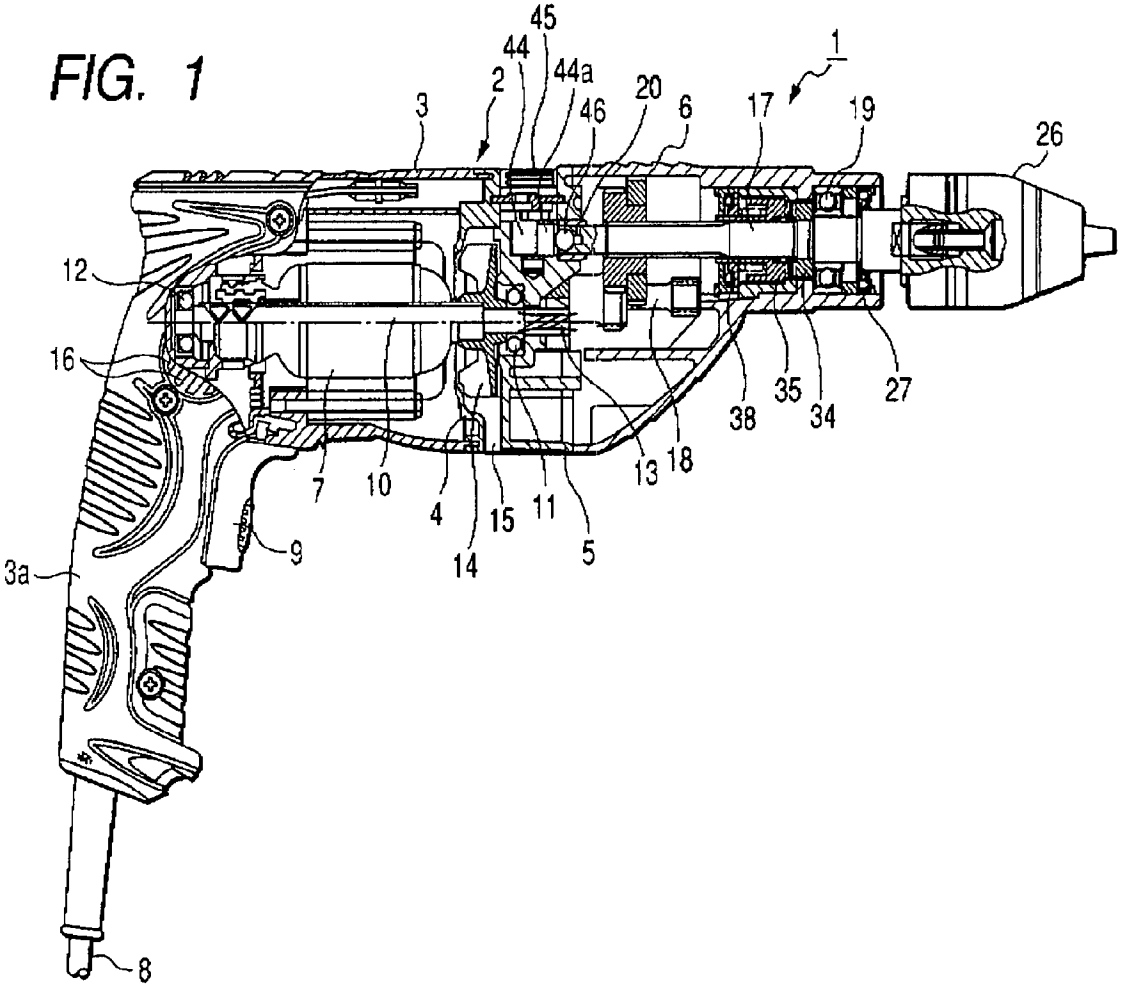
FIG. 1 is a broken sectional view of a vibration drill unit according to the invention.
Figure 2:
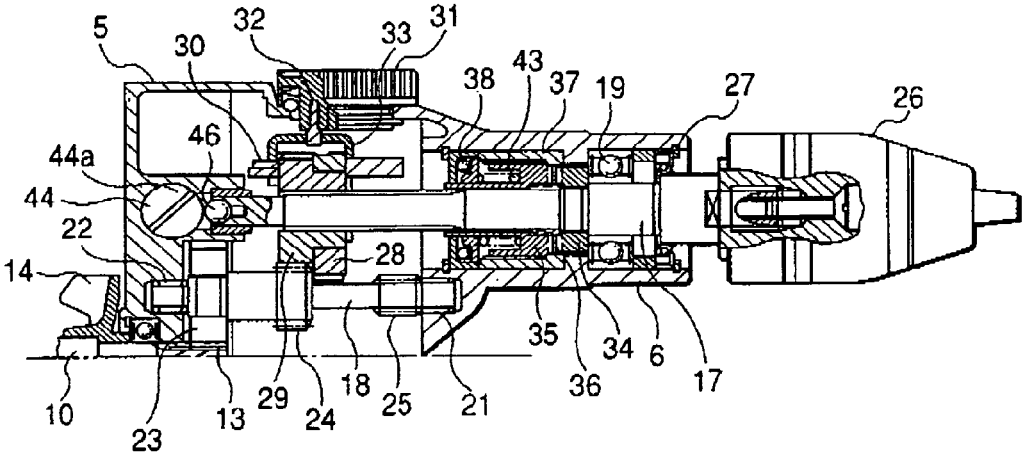
FIG. 2 is a broken side view of the distal end major portions, which shows a state of the drill mode of the same vibration drill unit according to the invention.
Figure 3:
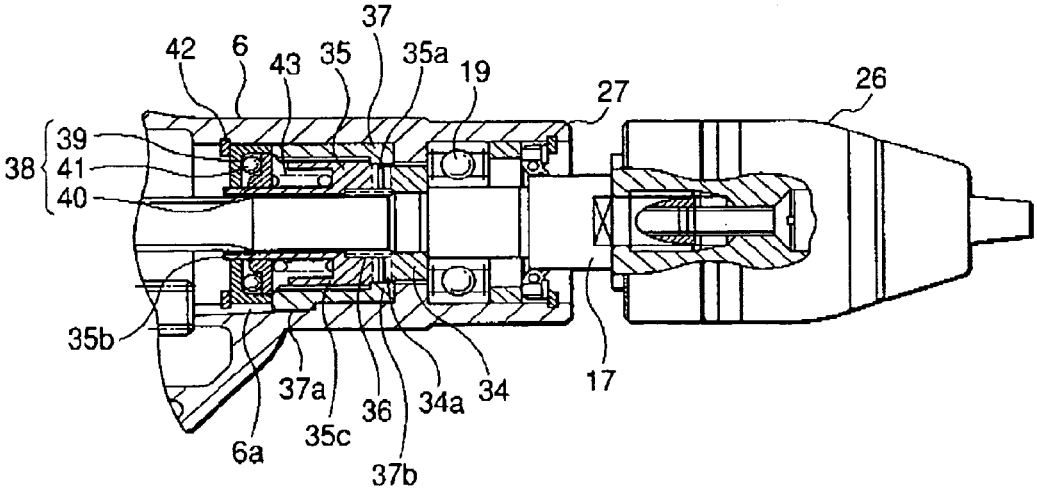
FIG. 3 is an enlarged detailed view of the major parts of FIG. 2.
Figure 4:
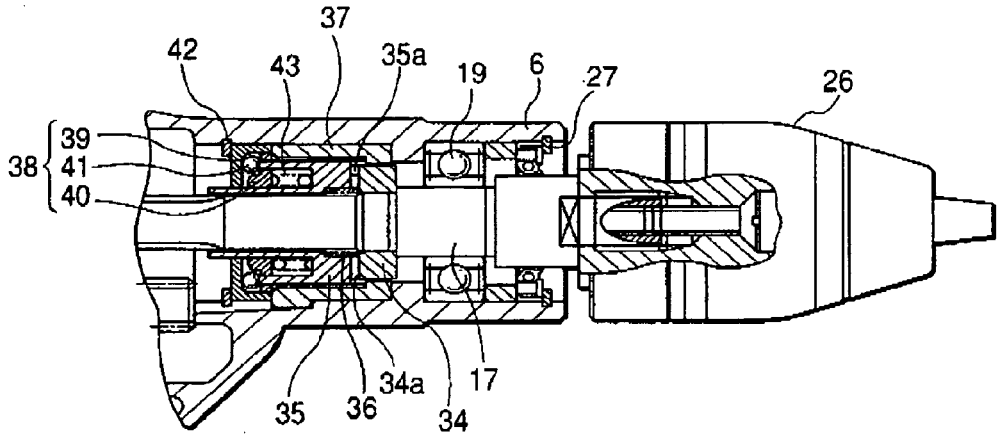
FIG. 4 is a broken side view of the distal end major portions, which shows a state of the vibration drill mode of the same vibration drill unit according to the invention.
Figure 5:
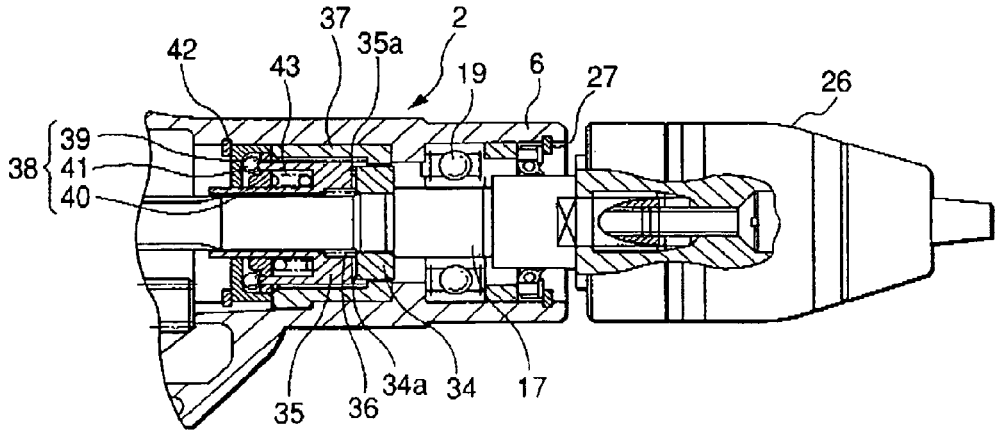
FIG. 5 is a broken side view of the distal end major portions, which shows a state of the vibration drill mode of the same vibration drill unit according to the invention.
Figure 6A:
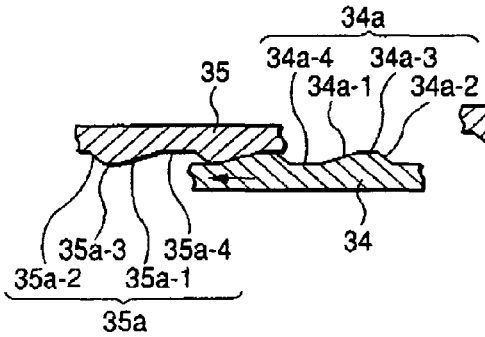
FIGS. 6(*a*) through 6(*c*) are views showing the shapes of respective claws of the first ratchet and the second ratchet of the same vibration drill unit, and showing states where the respective claws are engaged with and disengaged from each other.
Figure 6B:
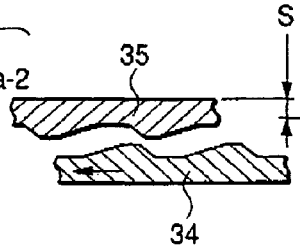
PRIOR ART FIG. 6B
Figure 6C:
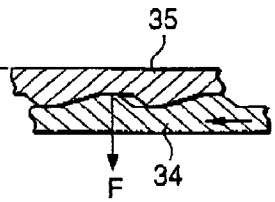
PRIOR ART FIG. 6C

FIG. 1 is a broken side view of a vibration drill unit according to the invention. FIG. 2 is a broken side view of the distal end major portion, which shows a state of the drill mode of the same vibration drill unit. FIG. 3 is an enlarged detailed view of the major parts of FIG. 2. FIG. 4 and FIG. 5 are broken side views of the distal end major portion, which show a state of the vibration drill mode of the same vibration drill unit. FIGS. 6(*a*) through 6(*c*) are views showing the shapes of respective claws of the first ratchet and the second ratchet of the same vibration drill unit, and showing states where the respective claws are engaged with and disengaged from each other.

As shown in FIG. 1, a vibration drill unit 1 according to the invention is provided with a main body frame 2 composed of resin-molded articles. The main body frame 2 is composed so that a housing 3, a fan casing 4, an intermediate cover 5 and a gear cover 6 are assembled to be integrated, and a motor 7 that is a drive source is horizontally accommodated in a lateral installation state in the housing 3 of the main body frame 2. Also, a handle portion 3*a* bent downward roughly orthogonal to the housing 3 is integrally formed at the rear end section of the handle 3. An electric cord 8 is introduced from downward into the handle portion 3*a*. The electric cord 8 is connected to the motor 7 via a switching mechanism (not illustrated) internally incorporated in the handle portion 3*a*. Also, the handle portion 3*a* is provided with a trigger switch 9 to turn on and off electric supply to the motor 7 by operating the switching mechanism.

Both end parts of the output shaft (motor shaft) 10 of the motor 7 are rotatably supported by bearings 11 and 12, and a pinion gear 13 is integrally formed at one end thereof (the forward protruding part from the forward bearing 11 to forward). Also, a centrifugal type cooling fan 14 accommodated in a fan casing 4 is coupled to the front end part (the portion rearward of the forward bearing 11) of the output shaft 10, and a plurality of exhaust ports 15 (only one port is illustrated in FIG. 1) are formed around the cooling fan 14 of the fan casing 4. In addition, a plurality of air suction ports are formed at the left and right sides of the rear part of the housing 3.

Further, as shown in detail in FIG. 2, a spindle 17 and an intermediate shaft 18 are disposed in the gear cover 6 parallel to the output shaft 10 of the motor 7, and both end parts of the spindle 17 are supported rotatably and movably in the axial direction by bearings 19 and 20. Also, both end parts of the intermediate shaft 18 are rotatably supported by bearings 21 and 22, wherein large and small gears 23, 24 and 25 having diameters differing from each other are provided on the intermediate portion thereof with adequate spacing in the axial direction, and the gear 23 is engaged with the pinion gear 13 formed on the output shaft 10 of the motor 7.

A drill chuck 26 that detachably mounts a drill bit (not illustrated) is attached to the distal end part protruding outwardly from the gear cover 6 of the spindle 17. An oil seal 27 that is brought into sliding contact with the outer circumferential surface of the spindle 17 is mounted at the distal end opening of the gear cover 6.

Also, as shown in FIG. 2, large and small gears 28 and 29 having diameters differing from each other, which are integrally coupled to the outer circumference of the rear half section of the spindle 17, are slidably spline-fitted thereto in the longitudinal direction. These gears 28 and 29 are caused to slide longitudinally on the spindle 17 by a shifter 33 sliding along a guide shaft 30 disposed parallel to the spindle 17.

Herein, a speed change dial 31 is rotatably mounted on the outer circumference of the gear cover 6. A pin 32 is erected at a position biased from the center of rotations of the speed change dial 31. The pin 32 is engaged with a long slot (not illustrated) formed in the channel-shaped shifter 33 that holds the gears 28 and 29 at both sides of the shifter 33, and rotation motions of the speed change dial 31 are converted to movement of the shifter 33 in the longitudinal direction by the pin 32. Therefore, as shown in FIG. 2, by turning the speed change dial 31 from a state where the small gear 29 at a small diameter side is engaged with the large-diameter gear 24 at the intermediate shaft 18 side, the gears 28 and 29 are caused to move forward along the spindle 17 by the shifter 33, and the gear 28 at a large diameter side is engaged with the small-diameter gear 25 at the intermediate shaft 18 side, wherein the speed reduction ratio is greatly changed, and the speed of rotations transmitted from the intermediate shaft 18 to the spindle 17 is lowered. Further, the rotation torque of the spindle 17 can be increased.

In addition, a cylindrical first ratchet 34 is coupled to the rear position of the bearing 19 of the spindle 17, and a double-cylindrical second ratchet 35 disposed adjacent to the first ratchet 34 is inserted slidably in the axial direction but not rotatably in the circumferential direction on the spindle 17, wherein the spindle 17 is freely rotatable with respect to the second ratchet 35. Convex and concave claws 34*a* and 35*a* are formed on the end face where the first ratchet 34 and the second ratchet 35 are opposed to each other, and are selectively engageable therewith. A spring 36 that presses the second ratchet 35 in the direction (rearward) along which it is spaced from the first ratchet 34 is compressed and mounted between both the ratchets 34 and 35.

Herein, shapes of the respective claws 34*a* and 35*a* formed on the first ratchet 34 and the second ratchet 35 are shown in FIGS. 6(*a*) through 6(*c*).

The respective claws 34*a* and 35*a* of the first ratchet 34 and the second ratchet 35 include the first inclined surfaces 34*a*-1 and 35*a*-1 formed so as to be engaged in the rotation direction by rotations of the first ratchet 34 in the direction of the illustrated arrow and so as to be separated from each other as shown in FIG. 6(*b*); the second inclined surfaces 34*a*-2 and 35*a*-2 having greater inclination in the reversed direction than the first inclined surfaces 34*a*-1 and 35*a*-1; top parts 34*a*-3 and 35*a*-3 that link the upper parts of both inclined surfaces 34*a*-1 and 34*a*-2, and 35*a*-1 and 35*a*-2 to each other; and flat parts 34*a*-4 and 35*a*-4 that link the bottom parts of both inclined surfaces 34*a*-1 and 34*a*-2, and 35*a*-1 and 35*a*-2 to each other.

A cylindrical sleeve 37 fitted to the inner circumference of the gear cover 6 is disposed on the outer circumferential side of the second ratchet 35. The sleeve 37 is prevented from turning by causing a projection 37*a* protruding from a part of the outer circumference thereof to be engaged in an engagement groove 6*a* formed on a part of the inner circumference of the gear cover 6 as shown in FIG. 3, and the second ratchet 35 is slidably spline-fitted longitudinally on the inner circumferential portion thereof.

Further, as shown in detail in FIG. 3, a supporting member 38 is fitted to and disposed at a position adjacent to the sleeve 37 in the gear cover 6. The supporting member 38 is composed so that an O-ring 41 intervenes, as a resilient body, between a fixed ring 39 and a movable ring 40, which are inserted to the outer circumference of the inner cylindrical portion of the second ratchet 35. Herein, the fixed ring 39 is fixed by the position thereof in the axial direction being regulated by a snap ring 42 fitted in the inner circumference of the gear cover 6, and the forward end face thereof is brought into contact with the rear end face of the sleeve 37. To the contrary, the movable ring 40 is longitudinally movable along the outer circumference of the inner cylindrical portion 35*a* of the second ratchet 35, wherein if a pressing force operating thereon is in a range of 400N or less, predetermined spacing is always secured between the movable ring 40 and the fixed ring 39, and metallic friction therebetween can be avoided. And, a spring 43 is compressed and mounted between the movable ring 40 and the second ratchet 35, and the second ratchet 35 is always pressed forward (to the first ratchet 34 side) by the spring 43. Also, nitrile butyl rubber (NBR) is employed as a material of the O-ring 41.

In this connection, in the vibration drill unit 1 according to the embodiment, the drill mode and the vibration drill mode can be selected as its operation modes. Hereinafter, a description is given of a change mechanism of the operation mode.

As shown in FIG. 1, a pin 44 rotatable around the vertical axis forming a right angle to the axial center of the spindle 17 is provided in the intermediate cover 5. A notched concave portion 44*a* is formed at the intermediate portion of the pin 44.

In addition, an operation mode change switch 45 is provided movably in the circumferential direction on the outer circumference of the intermediate cover 5, and if the mode change switch 45 is turned in the circumferential direction, its rotating motion is changed to a half-turn motion centering around the axis of the pin 44, wherein the columnar outer circumferential surface or the notched concave part 44*a* of the pin 44 is selectively oriented to the rear end portion of the spindle 17. Accordingly, the rear end portion of the spindle 17 is selectively brought into contact with the outer circumferential surface or the concave part 44*a* of the pin 44 via a ball 46, and the operation mode is changed to the drill mode or the vibration drill mode as described later.

Next, hereinafter, a description is given of operations of the vibration drill unit 1 constructed as described above, with the operation mode classified into the drill mode and the vibration drill mode.

1) Drill Mode

In the drill mode, as shown in FIG. 2, the rear end of the spindle 17 is brought into contact with the columnar surface of the pin 44 via the ball 46. In this state, as shown in detail in FIG. 3, the second ratchet 35 pressed forward by the spring 43 is brought into contact with the convex portion 37*b* formed on the inner circumference of the forward end part of the sleeve 37, wherein the movement thereof in the axial direction is locked. Therefore, the second ratchet 35 is spaced from the first ratchet 34, and spacing is formed, as illustrated, in the axial direction between both the ratchets 34 and 35, wherein the respective claws 34*a* and 35*a* of both the ratchets 34 and 35 are in a disengaged state.

In this connection, when carrying out a drilling work using the vibration drill unit 1, if the motor 7 is rotated and driven by turning on the trigger switch 9 and supplying electric currents to the motor 7, the output shaft 10 of the motor 7 is driven and rotated at a predetermined speed, and the rotation is reduced by the pinion gear 13 and the gear 23 and is transmitted to the intermediate shaft 18, wherein the intermediate shaft 18 is driven and rotated at a predetermined speed. The rotation of the intermediate shaft 18 is reduced by the gear 24 and gear 29, which are engaged with each other in the example shown in FIG. 2, and is transmitted to the spindle 17, wherein the spindle 17, the drill chuck 26 attached to the distal end thereof, and a drill (not illustrated) attached thereto are driven and rotated at a predetermined speed. At this time, since the first ratchet 34 and the second ratchet 35 are spaced from each other as described above, the second ratchet 35 is in a non-driven state, wherein vibration (impact) is not given from the second ratchet 35 to the spindle 17, and the spindle 17 keeps rotating without moving in the axial direction.

Also, the gears 28 and 29 are caused to move forward along the spindle 17 by turning the speed change dial 31 as described above, and the gear 28 at the large diameter side is engaged with the small-diameter gear 25 at the intermediate shaft 18 side, wherein since the reduction ratio is greatly changed, the speed of rotation transmitted from the intermediate shaft 18 to the spindle 17 is lowered and the rotating torque of the spindle is increased.

If, in a state where the drill is driven and rotated as described above, the drill is pressed to a material (not illustrated) to be drilled, with the main body frame 2 of the vibration drill unit 1 held, a drilling work is carried out on the material by a drill. However, in the drill mode, since the relative positional relationship between the first ratchet 34 and the second ratchet 35 remains unchanged even in a case where the main body frame 2 is pressed to the material to be drilled, and both the ratchets 34 and 35 are spaced from each other, no vibration is transmitted to the spindle 17, wherein the spindle 17, drill chuck 26 and drill keep rotating without making any vibration, and the material is merely drilled by the drill.

2) Vibration Drill Mode

If the pin 44 is turned half by operating the mode change switch 31, and the concave portion 44*a* of the pin 44 is opposed to the rear end part of the spindle 17, the operation mode is changed from the drill mode to the vibration drill mode. In this vibration drill mode, the spindle 17 is made movable rearward equivalent to the depth of the concave portion 44*a* of the pin 44.

In this connection, in the vibration drill mode, the rotation of the output shaft 10 of the motor 7 is reduced as in the drill mode, and is transmitted to the spindle 17. However, in a non-loaded state before the drill is pressed to a material to be drilled, the first ratchet 34 and the second ratchet 35 are spaced from each other by a pressing force of the spring 36, wherein no vibration is applied to the spindle 17, drill chuck 26 and drill, and these components are merely rotating.

In the above state, when the drill is pressed to a material (not illustrated) to be drilled, with the main body frame 2 of the vibration drill unit 1 held, the main body frame 2 moves forward to the spindle 17 while compressing the spring 36. Therefore, the second ratchet 35, sleeve 37 and supporting member 38 move integral with each other, and as shown in FIG. 4, the second ratchet 35 retracts in the sleeve 37 against the pressing force while compressing the spring 43 after the second ratchet 35 is brought into contact with the first ratchet 34, and the rear end portion of the outer cylindrical portion 35*c* is brought into contact with the movable ring 40 of the supporting member 38. For this reason, the movable ring 40 moves rearward along the outer circumference of the inner cylindrical portion 35*a* of the second ratchet 35, and compresses the O-ring 41 between the same and the fixed ring 39. However, at this time, since predetermined spacing is secured in the axial direction between the movable ring 40 and the fixed ring 39, metallic contact between both the rings 39 and 40 can be avoided.

When the second ratchet 35 is brought into contact with the first ratchet 34, as described above, in the vibration drill mode, the claws 34*a* and 35*a* of both the ratchets 34 and 35 are engaged with each other, and the first ratchet 34 rotates along with the spindle 17. As shown in FIG. 6(*a*), since the first inclined surfaces 34*a*-1 and 35*a*-1 of the respective claws 34*a* and 35*a* of the first ratchet 34 and the second ratchet 35 are engaged with each other, both the ratchets 34 and 35 are spaced from each other in the axial direction in the vertical direction as shown in FIG. 6(*b*).

After that, since the second ratchet 35 is brought into contact with the first ratchet 34 by a pressing force of the spring 43, the flat part 35*a*-4 of the claw 35*a* of the second ratchet 35 is brought into contact with the top part 34*a*-3 of the claw 34*a* of the first ratchet 34 as shown in FIG. 6(*c*), and at this time, the second ratchet 35 applies an illustrated impact force F to the first ratchet 34. In this case, the impact force F operates in the direction orthogonal to the flat part 35*a*-4, and the direction is coincident with the axial direction. Therefore, the entire kinetic energy of the second ratchet 35 is effectively utilized to vibrations in the axial direction of the spindle 17, drill chuck 26 and drill, wherein the energy loss can be suppressed to the minimum.

In addition, since, in a state where the top part 34*a*-3 of the claw 34*a* of the first ratchet 34 is engaged with the flat part 35*a*-4 of the claw 35*a* of the second ratchet 35 and in a state where the top part 35*a*-3 of the claw 35*a* of the second ratchet 35 is engaged with the flat part 34*a*-4 of the claw 34*a* of the first ratchet 34, a predetermined length is secured in the circumferential direction in the respective flat parts 34*a*-4 and 35*a*-4 so that the first ratchet 34 and the second ratchet 35 are rotatable relative to each other, the top part 35*a*-3 of the claw 35*a* impacts the flat part 34*a*-4 of the claw 34*a* even if the impact point changes due to a change in the rotation speed and the pressing force, and in the meantime, the impact force F is applied from the second ratchet 35 to the first ratchet 34 in the axial direction.

Figure 7A:
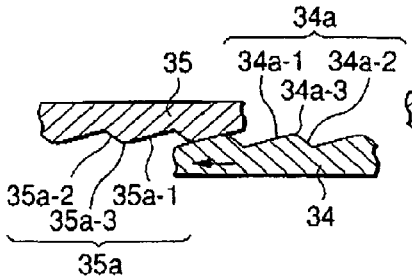
PRIOR ART FIG. 7A
FIGS. 7(*a*) through 7(*c*) are views showing the shapes of respective claws of the first ratchet and the second ratchet of the conventional vibration drill unit, and showing states where the respective claws are engaged with and disengaged from each other.
Figure 7B:
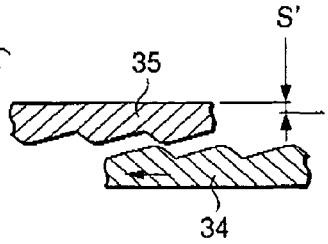
PRIOR ART FIG. 7B
Figure 7C:
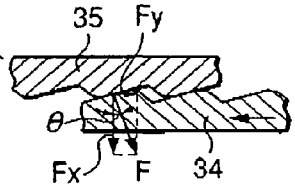
PRIOR ART FIG. 7C

Further, since, in the respective claws 34*a* and 35*a* of the first ratchet 34 and the second ratchet 35, the top parts 34*a*-3 and 35*a*-3 and the flat parts (bottom parts) 35*a*-4 and 34*a*-4 are brought into collision with each other as shown in FIG. 6(*c*), the axial direction stroke S of the second ratchet 35 is made longer than the stroke S' (S>S') of conventional vibration drill units (Refer to FIGS. 7(*a*)-(*c*)), wherein the relative speed between the second ratchet 35 and the first ratchet 34, that is, the kinetic energy is increased when the former is brought into collision with the latter.

As described above, since the first ratchet 34 and the second ratchet 35 repeat contacting and separating motions therebetween, the spindle 17 vibrates in the axial direction, and the vibration is transmitted from the spindle 17 to the drill via the drill chuck 26. Therefore, vibration is given to the drill simultaneously with rotation, wherein a drilling work of a material to be drilled can be efficiently carried out.

In this connection, in the vibration drill unit 1 according to the present embodiment, since the kinetic energy of the second ratchet 35 is increased, and the entirety of the large kinetic energy is effectively utilized for vibrations of the spindle 17, drill chuck 26 and a drill in the axial direction as described above, the energy loss can be suppressed to the minimum, and the drilling performance of the vibration drill unit 1 can be intensified.

In a state where the pressing force of the drill onto a material to be drilled is small, and the second ratchet 35 is not brought into contact with the movable ring 40 of the supporting member 38, vibrations of the second ratchet 35 are effectively absorbed mainly by expansion and contraction of the spring 43, and propagation of vibrations onto the main body frame 2 is suppressed. Accordingly, discomfort and fatigue, which are given to an operator who holds the handle portion 3*a* of the main body frame 2, can be relieved.

If the pressing force of a drill onto a material to be drilled is increased, and the second ratchet 35 is metallically brought into contact with the movable ring 40 of the supporting member 38 as shown in FIG. 4, the spring 43 does not achieve its vibration absorbing performance. However, since the O-ring 41 achieves vibration absorbing performance instead of the spring 43, vibrations of the second ratchet 35 can be effectively absorbed by elastic deformation of the O-ring 41, wherein propagation of vibrations to the main body frame 2 can be suppressed.

Herein, since the reaction of the spring 43, which the O-ring 41 receives via the movable ring 40, is increased in line with progress of compression of the spring 43 by an increase in the pressing force of the drill onto a material to be drilled, the elastic deformation amount of the O-ring 41 in the axial direction is increased. Therefore, contacting of the O-ring 41, which is linear contacting thereof with the fixed ring 39 and the movable ring 40 in a non-load state, is made into facial contacting in line with an increase in the pressing force of the drill onto the material, and the contacting area thereof is increased.

Accordingly, the pressing force of the drill onto the material is further increased. As shown in FIG. 5, the elastic deformation amount of the O-ring 41 is increased since the O-ring 41 is pressed with an intensive force by the movable ring 40. In this connection, since, in a range where the pressing force is 400N or less, metallic contacting of the movable ring 40 with the fixed ring 39 is avoided in the supporting member 38, and predetermined spacing is secured therebetween, vibrations of the second ratchet 35 are effectively absorbed by elastic deformation of the O-ring 41, and propagation of vibrations onto the main body frame 2 can be suppressed. As a result, even in a case where an intensive force is applied onto the main body frame 2, discomfort and fatigue of an operator can be relieved by suppressing the propagation of vibrations onto the main body frame 2.

What is claimed is:

1. A vibration drill unit, comprising:

a motor that is a drive source;

a spindle which is driven and rotated in a rotation direction by the motor and is movable in an axial direction thereof;

a first ratchet, coupled to the spindle, having convex and concave claws;

a non-rotatable second ratchet having convex and concave claws engageable with the convex and concave claws of the first ratchet; and a main body frame for accommodating the motor, the spindle, and the first and second ratchets, wherein the respective claws of the first ratchet and second ratchet have a first linearly rising inclined surface formed so as to be separated from each other by being engaged in the rotation direction based on rotations of the first ratchet, a second linearly falling inclined surface having a greater slope in the reverse direction of the first inclined surface than that of the first inclined surface, a ridge portion that links the respective top parts of both the inclined surfaces with each other, and a flat part that links the respective bottom parts of both the inclined surfaces with each other, wherein when the second ratchet engages the first ratchet, the second ratchet imparts a force to the first ratchet, thereby causing vibration in the spindle, wherein a direction of the force imparted by the second ratchet to the first ratchet is in the axial direction of the spindle, wherein the first ratchet and the second ratchet are capable of rotating relative to each other from a state where the ridge portion of one claw of the first and second ratchets abuts with the flat part of the other claw of the first and second ratchets, wherein, in each of the claws, the flat part is longer than the ridge portion in the rotation direction, wherein a spring for causing the second ratchet to slide in the axial direction and pressing the second ratchet to the first ratchet side is compressed and mounted between the second ratchet and the main body frame, wherein vibration drill unit includes an elastic material for absorbing vibrations of the second ratchet such that propagation of vibrations to the main body frame is suppressed, and wherein the elastic material is disposed between the main body frame and the spring.

2. The vibration drill unit according to claim 1, wherein the vibration drill unit can selectively be placed in a drill mode in which the spindle performs a drilling operation or a vibration and drill mode in which the spindle performs a drilling and vibration operation.

3. The vibration drill unit according to claim 1, wherein the vibration drill unit is selectively placed in a drill mode in which the spindle performs a drilling operation or a vibration and drill mode in which the spindle performs a drilling and vibration operation.

4. The vibration drill unit according to claim 2, wherein vibrations of the second ratchet can be effectively absorbed by an elastic material such that propagation of vibrations to the main body frame can be suppressed.

5. A vibration drill unit having a spindle, wherein vibrations are imparted to the spindle in an axial direction thereof, said vibration drill unit comprising:

a motor that is a drive source, wherein the spindle is driven and rotated in a rotation direction by the motor and is movable in an axial direction thereof;

a first ratchet, coupled to the spindle, having convex and concave claws;

a non-rotatable second ratchet having convex and concave claws engageable with the convex and concave claws of the first ratchet; and a main body frame for accommodating the motor, the spindle, and the first and second ratchets, wherein the respective claws of the first ratchet and second ratchet have a first linearly rising inclined surface formed so as to be separated from each other by being engaged in the rotation direction based on rotations of the first ratchet, a second linearly falling inclined surface having a greater slope in the reverse direction of the first inclined surface than that of the first inclined surface, a ridge portion that links the respective top parts of both the inclined surfaces with each other, and a flat part that links the respective bottom parts of both the inclined surfaces with each other, wherein when the second ratchet engages the first ratchet, the second ratchet imparts a force to the first ratchet, thereby causing vibration in the spindle, wherein a direction of the force imparted by the second ratchet to the first ratchet is in the axial direction of the spindle, wherein the direction of the force imparted by the second ratchet to the first ratchet in the axial direction of the spindle causes vibration of the spindle in the axial direction, wherein the first and second ratchets are arranged so that the convex and concave claws of the first and second ratchets are facing each other along a circumferential direction of the spindle, wherein the flat parts of the first and second ratchets each forms a right angle with the axial direction of the spindle so that an impact force between the flat parts and the ridge portions are coaxially transmitted to the spindle, wherein, in each of the claws, the flat part is longer than the ridge portion in the rotation direction, wherein a spring for causing the second ratchet to slide in the axial direction and pressing the second ratchet to the first ratchet side is compressed and mounted between the second ratchet and the main body frame, wherein vibration drill unit includes an elastic material for absorbing vibrations of the second ratchet such that propagation of vibrations to the main body frame is suppressed, and wherein the elastic material is disposed between the main body frame and the spring.

6. The vibration drill unit according to claim 1, wherein, when the first ratchet rotates in a state where the ridge portion of one claw is in contact with the flat part of the other claw, the spindle does not move along the axial direction.

7. The vibration drill unit according to claim 1, wherein the flat parts are formed to be substantially orthogonal to the axial direction.

8. A vibration drill unit, comprising:

a motor that is a drive source;

a spindle which is driven and rotated in a rotation direction by the motor and is movable in an axial direction thereof;

a first ratchet, coupled to the spindle, having convex and concave claws; and a second ratchet disposed slidably in the axial direction but not rotatably in a circumferential direction on the spindle, the second ratchet having convex and concave claws engageable with the convex and concave claws of the first ratchet, wherein said respective claws of the first ratchet and second ratchet including a first linearly rising inclined surface and a second linearly falling inclined surface having a greater slope in the reverse direction of the first inclined surface than that of the first inclined surface, a ridge portion that links the respective top parts of both the inclined surfaces with each other, and a bottom portion having a flat surface and linking the respective bottom parts of both the inclined surfaces with each other;

a first spring that presses the second ratchet in a first axial direction so as to have a space between the first and the second ratchet; and a housing for accommodating the motor, the spindle, and the first and second ratchets, wherein when the drill is pressed to a material to be drilled, the second ratchet engages the first ratchet so as to cause vibration in the spindle, wherein the vibration drill further comprises:

a second spring that presses the second ratchet in a second axial direction which is opposite to the first axial direction; and an elastic member disposed at a position adjacent to the second ratchet to absorb vibrations caused by the second ratchet to a main body frame, and wherein the elastic material is disposed between the main body frame and the second spring.

9. The vibration drill unit according to claim 8, which further comprises:

an operation mode change switch provided on the housing so as to select one of a drill mode in which the spindle performs a drilling operation and a vibration and drill mode in which the spindle performs a drilling and vibration operation.

10. The vibration drill unit according to claim 8, wherein the second ratchet comprises:

an inner cylindrical member and an outer cylindrical member connected to each other and a movable ring is provided movably along the outer circumference of the inner cylindrical member.

11. The vibration drill unit according to claim 10, wherein when a pressing force operating on the drill is less than a predetermined value, predetermined spacing is always secured between the movable ring and a fixed ring disposed in the housing.

12. A vibration drill unit comprising:

a motor that is a drive source;

a spindle which is driven and rotated in a rotation direction by the motor and is movable in an axial direction thereof;

a first ratchet, coupled to the spindle, having convex and concave claws; and a second ratchet disposed slidably in the axial direction but not rotatably in a circumferential direction on the spindle, the second ratchet having convex and concave claws engageable with the convex and concave claws of the first ratchet, wherein said respective claws of the first ratchet and second ratchet including a first linearly rising inclined surface and a second linearly falling inclined surface having a greater slope in the reverse direction of the first inclined surface than that of the first inclined surface, a ridge portion that links the respective top parts of both the inclined surfaces with each other, and a bottom portion having a flat surface and linking the respective bottom parts of both the inclined surfaces with each other;

a housing for accommodating the motor, the spindle, and the first and second ratchets, wherein when the second ratchet engages the first ratchet, the second ratchet imparts a force to the first ratchet, thereby causing vibration in the spindle, wherein the flat parts of the first and second ratchets each forms a right angle with the axial direction of the spindle so that an impact force between the flat parts and the ridge portions are coaxially transmitted to the spindle, wherein a spring for causing the second ratchet to slide in the axial direction and pressing the second ratchet to the first ratchet side is compressed and mounted between the second ratchet and a main body frame, and wherein vibration drill unit includes an elastic material for absorbing vibrations of the second ratchet such that propagation of vibrations to the main body frame is suppressed, and wherein the elastic material is disposed between the main body frame and the spring.

13. A vibration drill comprising the vibration drill unit according to claim 1.

14. A vibration drill unit, comprising:

a motor;

a spindle that is driven and rotated by the motor and is movable in an axial direction;

a first ratchet coupled to the spindle;

a second ratchet engageable with the first ratchet; and a main body frame that accommodates the second ratchet, wherein the first ratchet includes:

a first linearly rising inclined surface; and a second linearly falling inclined surface, wherein an inclination of the first linearly rising inclined surface is larger than an inclination of the second linearly falling inclined surface, wherein the second ratchet includes:

a third linearly rising inclined surface; and a fourth linearly falling inclined surface, wherein an inclination of the third linearly rising inclined surface is larger than an inclination of the fourth linearly falling inclined surface, wherein the first ratchet further includes a flat portion connecting a lower end of the first linearly rising inclined surface and a lower end of the second linearly falling inclined surface, wherein the second ratchet further includes a ridge portion connecting an upper end of the third linearly rising inclined surface and an upper end of the fourth linearly falling inclined surface, wherein the flat portion is longer than the ridge portion, wherein a spring for causing the second ratchet to slide in the axial direction and pressing the second ratchet to the first ratchet side is compressed and mounted between the second ratchet and the main body frame, wherein vibration drill unit includes an elastic material for absorbing vibrations of the second ratchet such that propagation of vibrations to the main body frame is suppressed, and wherein the elastic material is disposed between the main body frame and the spring.

* * * * *